United States Patent [19]

Atkinson et al.

[11] Patent Number: 4,475,420

[45] Date of Patent: Oct. 9, 1984

[54] WRENCH APPARATUS AND BAR MEANS FOR SELECTIVELY APPLYING TORQUE FORCES TO A WORKPIECE

[75] Inventors: Thomas Atkinson, Wakefield, Mass.; Thomas R. Dowd, 23 Avon St., Wakefield, Mass. 01880

[73] Assignee: Thomas R. Dowd, Reading, Mass.

[21] Appl. No.: 372,894

[22] Filed: Apr. 29, 1982

[51] Int. Cl.[3] ..... B25B 13/46; B25B 17/02

[52] U.S. Cl. ..... 81/58.3; 81/63; 74/781 R

[58] Field of Search ..... 81/57.3, 57.31, 57.39, 81/58.1, 58.3, 62, 63; 74/781 R, 760, 761

[56] References Cited

U.S. PATENT DOCUMENTS

| | | | |
|---|---|---|---|
| Re. 29,993 | 5/1979 | Wagner | 81/57.31 X |
| 2,510,483 | 6/1950 | Schnepel et al. | 81/57.31 X |
| 2,520,443 | 8/1950 | Seaquist | 81/57.11 X |
| 2,634,630 | 4/1953 | Johnson | 81/57.31 X |
| 2,780,944 | 2/1957 | Ondeck | 81/57.31 X |
| 3,587,364 | 6/1971 | Peyre | 81/57.39 |
| 3,945,274 | 3/1976 | Annett | 81/58.1 |
| 3,992,964 | 11/1976 | Osmond | 81/57.31 |
| 4,069,726 | 1/1978 | Garconnet | 81/57.31 X |
| 4,159,050 | 6/1979 | Hopkins, Sr. et al. | 81/58.3 X |

*Primary Examiner*—Frederick R. Schmidt
*Assistant Examiner*—Debra S. Meislin
*Attorney, Agent, or Firm*—Munroe H. Hamilton

[57] ABSTRACT

A ratchet wrench apparatus includes a housing body having a lever portion extending outwardly from one side thereof to apply a torque force. A gear assembly received in the housing consists of a universal gear, planetary gears and a sun gear which are rotatably driven in unison in response to a torque force exerted through a ratchet gear adjustably disposed in the handle and housing. An output torque force is transmitted from the gear assembly through a rotor body which is normally held in interlocking relationship with the sun gear in the gear assembly. The apparatus further includes a separate selector bar element which may be manually inserted in the gear assembly to enable the rotor body to rotate independently of the sun gear when a torque force is being exerted through the lever and remaining gears.

4 Claims, 9 Drawing Figures

WRENCH APPARATUS AND BAR MEANS FOR SELECTIVELY APPLYING TORQUE FORCES TO A WORKPIECE

FIELD OF THE INVENTION

It is well known in the art to provide ratchet wrench mechanisms and to combine with such mechanisms gear means such as ring gears, planetary gears and sun gears arranged in various ways in housing members with which a handle or lever element is provided to exert a torque force on a work piece. Thus, for example, wrench mechanisms of this constructions are disclosed in the following patents: U.S. Pat. No. 2,520,443 entitled Planetary Gear Speed Wrench; U.S. Pat. No. 3,587,364 entitled Two Armed Ratchet Wrench; U.S. Pat. No. 2,634,620 entitled Geared Wrench; U.S. Pat. No. 4,069,726 entitled Tightening and Releasing Tool; U.S. Pat. No. Re. 29,993 entitled Gear Wrench; U.S. Pat. No. 2,510,483 entitled Speed and Power Geared Hand Wrench; and U.S. Pat. No. 3,945,274 entitled Speed Wrench.

In all of these prior art devices means are provided for shifting from one mode of operation to another mode to multiply torque forces and adjustment controls are combined with a standard ratchet wrench mechanism in one housing body. In all of these devices the components and their adjustable controls are complicated in construction, expensive to manufacture and assemble and require special handling to convert from one mode to another. In none of these prior art devices, as far as is known, is there provided a means for manually changing from one mode of operation to another mode while a torque force is being exerted.

SUMMARY OF THE INVENTION

This invention relates to an improved ratchet wrench apparatus of the class wherein a conventional ratchet mode of operation may be changed to a torque multiplying mode by the use of gear means such as ring gears, planetary gears and sun gears.

It is a chief object of the invention to provide an improved ratchet wrench apparatus and to devise an arrangement of wrench components by means of which a conventional ratchet mode of applying a torque force to a work piece may be converted to a torque multiplying mode while the torque force is being applied.

Another object is to devise a wrench apparatus by means of which a two-handed operation may be employed to provide for rapidly and conveniently changing from a conventional ratchet mode of operation to a torque multiplying mode of operation. Still another object of the invention is to provide a ratchet wrench apparatus which may be readily manufactured and assembled and which provides for increased ease of handling and more rapid and efficient application of torque forces.

These objectives are accomplished by providing a suitable housing body and lever means in which is located an assembly of gears by means of which a conventional ratchet gear movement is employed to exert a torque force to a work piece in one mode of operation and in which an operator utilizes only one hand. There is further provided a separate selector bar element which may be manually engaged in the gear assembly to carry out, at will, a torque multiplying mode of operation in which an operator utilizes both hands in a selective manner. This change in mode of operation from a conventional ratchet drive to a torque multiplying mode may be carried out, at will, in a rapid and convenient manner and instantly reversed when so desired.

DETAILED DESCRIPTION OF THE INVENTION

Figure 1:
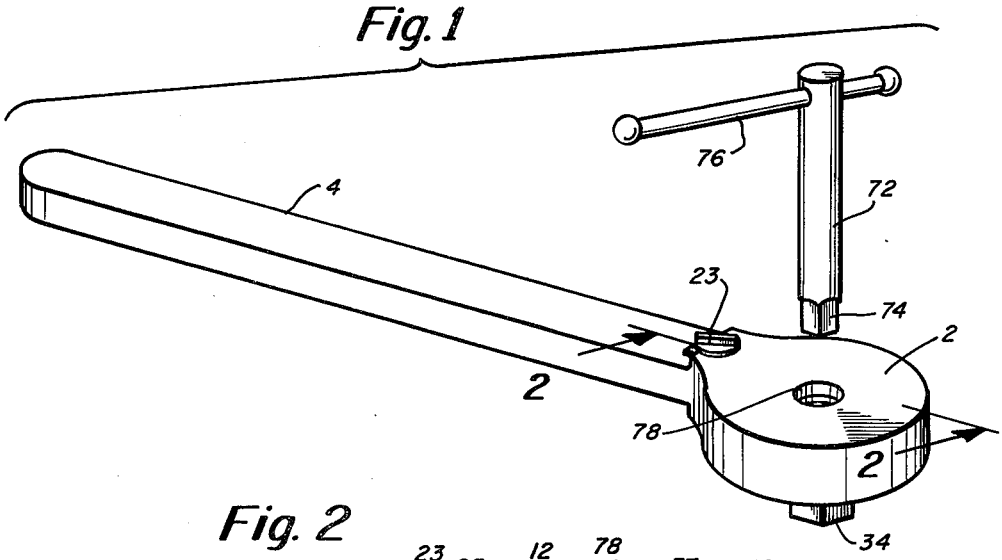
FIG. 1 is a perspective view of the ratchet wrench apparatus of the invention.

Referring in more detail to the structure shown in the drawings, numeral 2 denotes a housing body which may be of cylindrical configuration and which is provided at one side thereof with a lever part 4 by means of which a rotary turning may be manually carried out to exert a torque force against a work piece with which the housing body may be engaged, as hereinafter disclosed.

Mounted in the housing body 2 is a gear assembly which generally includes a universal or ring gear formed with inner and outer gear teeth, planetary gears in mesh with the inner gear teeth of the ring gear and a sun gear in mesh with each of the planetary gears.

The ring gear is indicated by numeral 6 and at its outer gear portion by numeral 6A and its inner gear portion by numeral 6B. The gear portions 6A and 6B are constructed of a limited axial length to define relieved upper and lower annular bearing edges 6C and 6D respectively.

Figure 2:
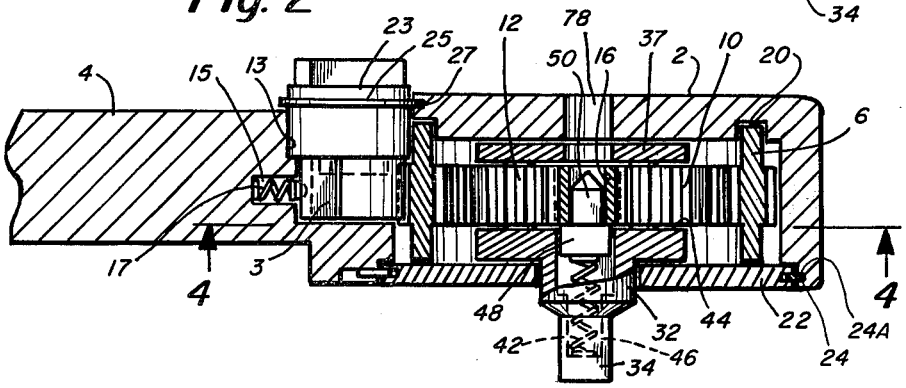
FIG. 2 is a cross-section taken on the line 2—2 of FIG. 1.
Figure 3:
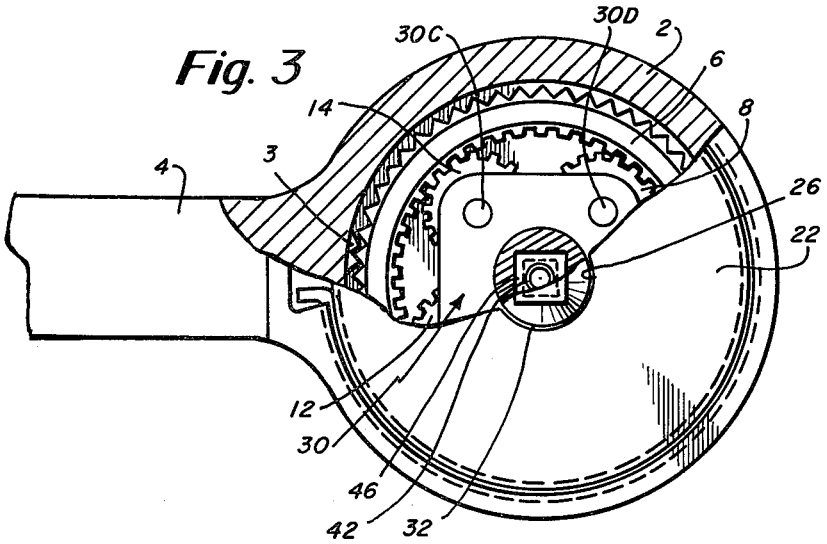
FIG. 3 is a bottom plan view of the wrench housing body partly broken away.
Figure 7:
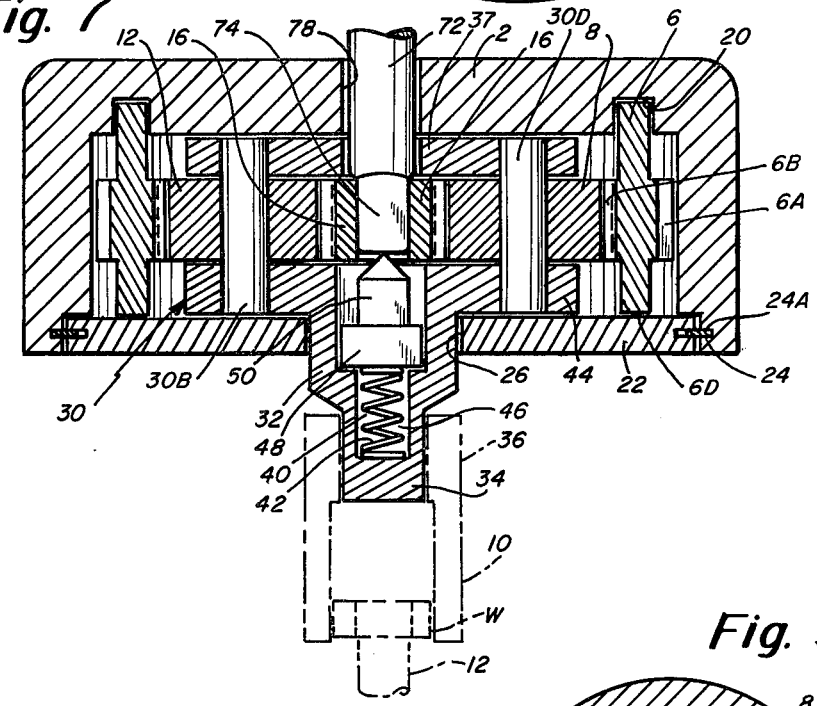
FIG. 7 is a cross-section taken on the line 7—7 of FIG. 6 and further illustrating the selector bar engaged to release a locking pin part.
Figure 5:
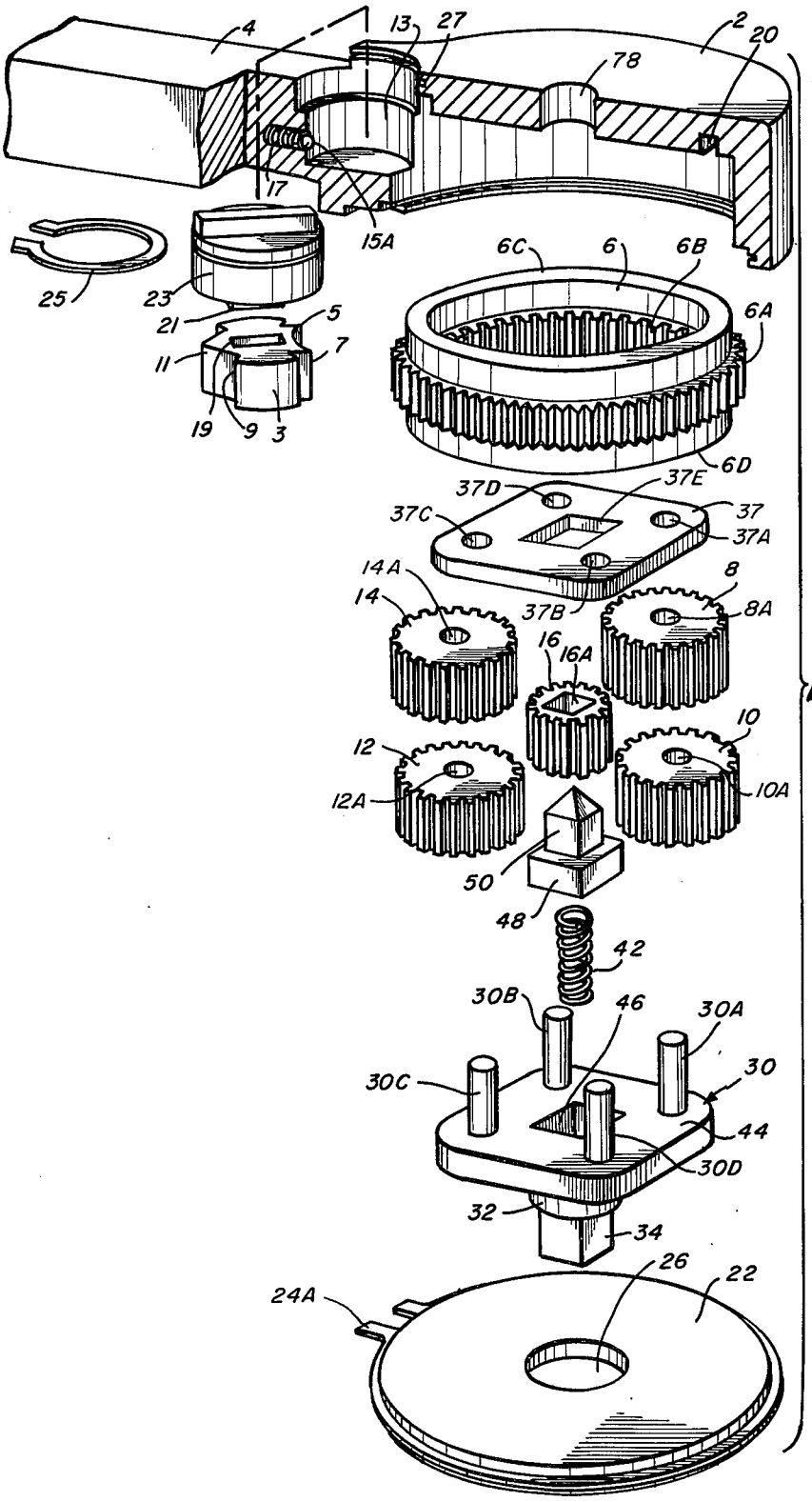
FIG. 5 is an exploded view illustrating the various components of the wrench invention indicated in perspective.

As illustrated in FIGS. 2 and 5, the housing body 2 is formed with an annular recess 20 in which the upper bearing edge 6C of the ring gear is rotatably received. The lower annular bearing edge 6D is supported by a retaining part 22 which is secured by a spring clip 24A which is designed to be snapped into locking engagement with an annular slot 24 formed around the inner wall of the housing 2, as is best shown in FIG. 7.

Figure 4:
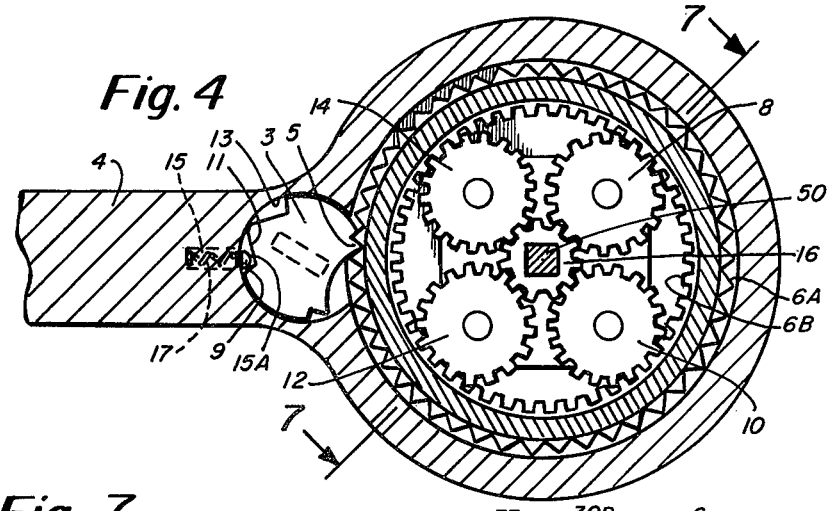
FIG. 4 is a cross-section taken on the line 4—4 of FIG. 2.

Adjustably supported in the lever part 4 and extending into the housing body 2 is a reversable ratchet gear 3 which is of conventional construction and which is illustrated in FIGS. 2, 4 and 5. As is customary in devices of this nature the ratchet gear 3 is provided with gear teeth as 5 and 7, which may be selectively engaged with the outer gear portion 6A of the ring gear 6. At an opposite side the ratchet gear 3 is constructed with the usual short ramp surface 9 and long ramp surface 11, best shown in FIGS. 4 and 5.

As shown in FIGS. 2 and 4, the lever 4 and the housing body 2 are formed with a retaining opening 13 at one side of which is provided a spring slot 15 and a ball 15A which is resiliently received against a coiled spring 17. The ratchet gear 3 has a slot 19 in which is engaged a projecting part 21 (FIG. 5) of a thumb selector element 23. The thumb selector element is rotatably held in the lever and housing by means of a snap ring 25 engageable in the slot 27, as indicated in FIG. 2.

The thumb selector may be employed in the usual manner to turn ratchet gear 3 into a position such as that shown in FIG. 4 wherein the short ramp 9 jams the ball 15A against the spring slot 15 and the ratchet teeth mesh in driving relation with the gear portions 6A and thus transmit a force through the lever 4 to turn the ring 6.

To reverse the ratchet mechanism the thumb selector 23 is turned in a reversed direction causing the long ramp 11 to force ball 15A into the slot and allows the ratchet piece to slip by and take up a reverse locking position.

The planetary gears above-noted are indicated by numerals 8, 10, 12 and 14 and are supported on a rotor body 30. The rotor body is illustrated in FIGS. 2, 3, 5 and 7 and may have a shape as is most clearly shown in FIG. 5. At an upper side 44 of the rotor body 30 are provided posts 30A, 30B, 30C and 30D (FIG. 5) which are arranged to engage through openings 8A, 10A, 12A and 14A of respective planetary gears and through openings 37A, 37B, 37C, and 37D of a spacer plate 37. The sun gear is denoted by numeral 16 and is formed with an opening 16A, which is best shown in FIG. 5 and is of a substantially square cross section. The sun gear has its opening 16A supported on a locking pin mechanism which is described below in more detail.

In accordance with the invention, the rotor body 30 is constructed at a lower portion thereof with a depending driver part 32 which projects through the retaining plate and terminates in a socket engaging end 34 of substantially square cross section. The engaging end 34 is designed to be engaged in a conventional socket 36 indicated in broken lines in FIG. 7 engaged with the work piece W.

Formed in the engaging part 34, as shown in FIGS. 2, 5 and 7, is a recess or well 46 in which is resiliently received a coil spring 42. The spring 42 has mounted at an upper end thereof a base section 48 having a locking pin 50 supported through the sun gear opening 16A. The well 46 is in communication with the opening 16A of the sun gear, also opening 37E in spacer plate 37, as well as opening 78 in the housing 2 and the base section 48 is made of a size to fit snugly inside the well 46.

Formed internally of the driver part 32 at the lower end thereof is an opening 40, best shown in FIG. 7, in which is received a coiled spring 42. At the upper side of the rotor body 30 is a gear plate part 44 which is formed integrally with the driver part 32 and which is recessed to provide a well 46 which is in communication with the cylindrical opening 40. The well 46 is, however, of substantially square shape and is designed to contain therein a square base section 48 of a locking pin 50 which is normally held in an extended position by the coiled spring 42, as illustrated in FIG. 2.

Also provided in the gear plate 44 are posts 30A, 30B, 30C and 30D which are constructed and arranged to have received therearound the planetary gears 8, 10, 12 and 14.

It will be seen that with the rotor body 30 and locking pin 50 combined with the planetary gears and sun gear as disclosed, when a turning force is exerted through the lever 4 it will drive the engaging end 34 to turn the work piece with a considerable torque force being exerted.

An important feature of the invention comprises in combination with the wrench mechanism disclosed above of a selector bar member which is most clearly shown in FIG. 1 and denoted by the numeral 72. As shown therein, the selector bar consists of an elongated body which is formed with a lower extremity of a square cross-section indicated as numeral 74.

Transversely disposed through an upper end of member 72 is a handle part 76. At the top of housing 2 is provided a hole 78 through which the member 72 may be inserted and the square cross-section extremity of the bar may be entered in an opening 16A of the sun gear 16 to engage against the head of locking pin 50 to force the pin downwardly against a coil spring 42 into a position as shown in FIG. 7. In this position it will be observed that pin 50 no longer locks the rotor body to the sun gear and therefore the rotor body is free to turn with respect to the sun gear.

In utilizing the lever, housing and gear assembly, without applying the selector 72, the ratchet gear 3 is adjusted to provide, as desired, either clockwise or counter-clockwise rotation of a work piece such as the bolt indicated at W in FIG. 7. A torque force applied through the lever 4 is exerted around the ring gear 6, planetary gears 8, 10, 12 and 14 and sun gear 16 and an output torque force is transmitted from the gear housing through the rotor body 30 to the workpiece W with the usual mechanical advantage being obtained and with the operator using only one hand.

Figure 6:
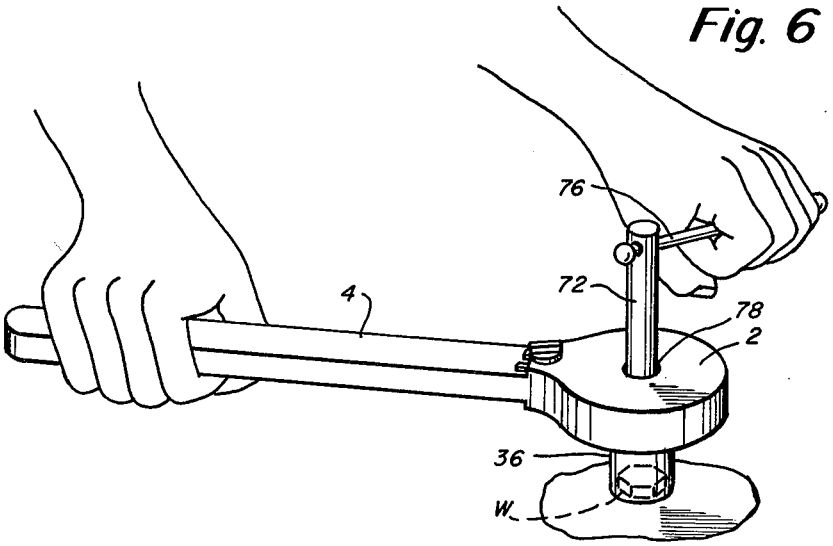
FIG. 6 is a diagrammatic view showing the wrench mechanism and the selector bar held in the two hands of an operator to carry out a torque applying force.

However, assuming that it becomes desirable to multiply the torque force several times so as to greatly increase the mechanical advantage obtainable, then the operator holds the lever 4 in one hand and in the other hand grips the handle 76 of the selector bar 72 in the manner suggested in FIG. 6. The bar is thereafter inserted through the hole 78 in the housing and is forced downwardly into contact with the upper end of locking pin 50 to displace this locking pin downwardly against the spring 42 and out of engagement with the sun gear 16.

With downward pressure continuously held to the selector bar 72 the operator then exerts a torque force through the lever 4 and with the ratched gear located in a desired position this gear turns the ring gear 6 which in turn rotates the planetary gears 8, 10, 12 and 14 about their respective posts 30A, 30B, 30C and 30D respectively while still in mesh with the sun gear. However, since the planetary gears are in mesh with the sun gear and the sun gear is held in a stationary position by the left hand of the operator the planetary gears are caused to travel around the sun gear and simultaneously drive the rotor body which is now free to turn independently of the sun gear. There is thus realized a multiplying of the torque force applied to a lever 4 and a greatly increased mechanical advantage may be derived.

Figure 9:
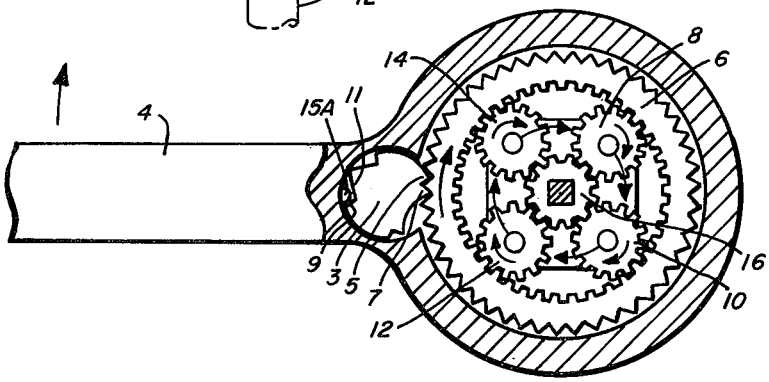
FIG. 9 is a view similar to FIG. 8 but illustrating the components being turned in an opposite direction with the ratched gear having been reversed.
Figure 8:
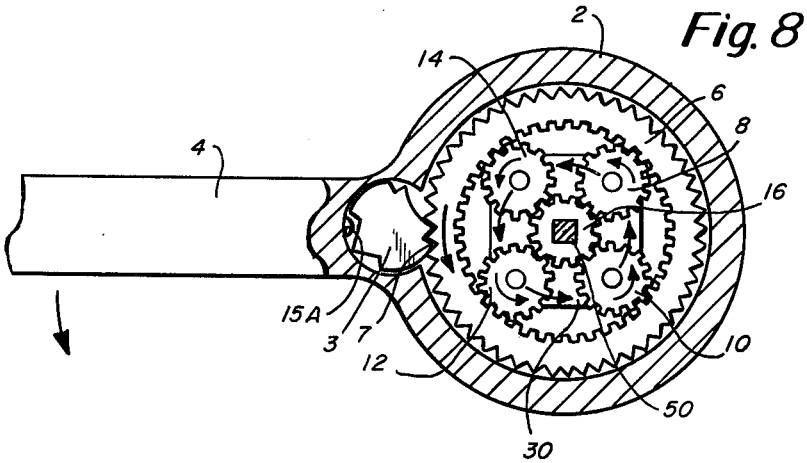
FIG. 8 is a schematic view partly in cross-section illustrating by directional arrows the rotational movement of the planetary gears and also the posts on which these gears are mounted.

In FIG. 8 the wrench apparatus is illustrated diagrammatically with the rotation of the planetary gears about their respective posts being indicated by one set of directional arrows and rotation of the posts and rotor body being indicated by a second set of directional arrows. FIG. 9 illustrates two sets of directional arrows moving in an opposite direction with a ratchet gear 3 having been reversed in position.

It will be observed that the invention apparatus provides for a rapid and convenient mold of changing the multiplication of the torque forces and this is carried out with only a single manual movement and can be instantly released or applied as desired. The parts are of simple construction and may be easily manufactured and sold.

We claim:

1. A ratchet wrench apparatus for applying a torque force to a work piece, including a cylindrical housing body formed with an opening at the upper side thereof and having a lever body extending radially outwardly therefrom, a ring gear rotatably mounted in the housing and presenting inner and outer gear teeth, a ratchet gear mechanism adjustably supported in the said lever body and engageable with the outer teeth of the ring gear to exert turning forces on the ring gear when the lever body is turned, spacer means located at the upper side of the ring gear, retaining plate means detachably secured at the under side of the housing in a position to support the ring gear, a rotor body supported in the housing on the retaining plate means and having a depending socket driver portion located through the retaining plate means, post elements fixed at the upper side of the rotor body, planetary gears mounted on the post elements in mesh with the inner gear teeth of the said ring gear, a sun gear supported on the rotor body in a position to mesh with the planetary gears and rotate with the planetary gears when the lever body is rotated, said sun gear being internally recessed to form an opening which is of substantially square cross section and the rotor body being formed with a recess having a coiled spring received therein, said coiled spring having a locking pin device attached to the upper side thereof, said locking pin device consisting of a locking pin of substantially square cross section which is movable in the opening in the said sun gear, said coiled spring normally urges the locking pin in engagement with the sun gear to hold the sun gear in a position to mesh with the planetary gears and to rotate with these gears when the lever body is turned, a selector bar element engageable through the housing and sun gear opening to move the locking pin device downwardly out of engagement with the sun gear and into engagement with the recess of the rotor body and said selector bar when held in a downwardly located position being operable to hold the sun gear stationary and to allow the rotor body and planetary gears to rotate relative to the sun gear when the lever body is turned thus providing a torque multiplying mode of operation.

2. The invention of claim 1 in which the recess in the rotor body is of a size exceeding the size of the opening in the sun gear and is of substantially square cross section, and the locking pin device includes a pin member which sets into the opening in the sun gear and which has a lower end consisting of a base part which coincides in size and shape with the recess in the driver part.

3. The invention of claim 2 in which the inner and outer gear portions of the ring gear are of limited axial length to define annular rim portions which are rotatably confined in the housing body.

4. The invention of claim 3 in which the selector bar includes a handle part transversely disposed through the upper end thereof for holding the sun gear stationary when depressed.

* * * * *